United States Patent [19]

Sitte

[11] Patent Number: 4,637,226

[45] Date of Patent: Jan. 20, 1987

[54] DEVICE FOR THE CRYOGENIC TRANSFER OF SPECIMENS

[75] Inventor: Hellmuth Sitte, Seefeld, Austria

[73] Assignee: C. Reichert Optishe Werke, AG, Vienna, Austria

[21] Appl. No.: 765,639

[22] Filed: Aug. 15, 1985

[30] Foreign Application Priority Data

Aug. 18, 1984 [DE] Fed. Rep. of Germany ..... 3430471

[51] Int. Cl.[4] ..... F25B 19/00

[52] U.S. Cl. ..... 62/514 R; 62/64; 62/78

[58] Field of Search ..... 62/64, 78, 514 R

[56] References Cited

U.S. PATENT DOCUMENTS

| | | | |
|---|---|---|---|
| 3,092,974 | 6/1963 | Haumann et al. | 62/64 |
| 3,228,838 | 1/1966 | Rinfret et al. | 62/78 |
| 4,388,814 | 6/1983 | Schilling | 62/78 |
| 4,487,033 | 12/1984 | Sakao et al. | 62/514 R |
| 4,489,569 | 12/1984 | Sitte | 62/514 R |

*Primary Examiner*—Ronald C. Capossela

*Attorney, Agent, or Firm*—Alan H. Spencer

[57] ABSTRACT

A device for use in transferring a specimen from an apparatus containing a cryogenic coolant, comprises a specimen holder and coolant transfer means. The coolant transfer means permits coolant from within the apparatus to be introduced into the specimen holder in order to immerse a specimen within the specimen holder in the coolant. This enables the specimen holder to be transferred to another apparatus, while the specimen is kept cool by the coolant.

20 Claims, 3 Drawing Figures

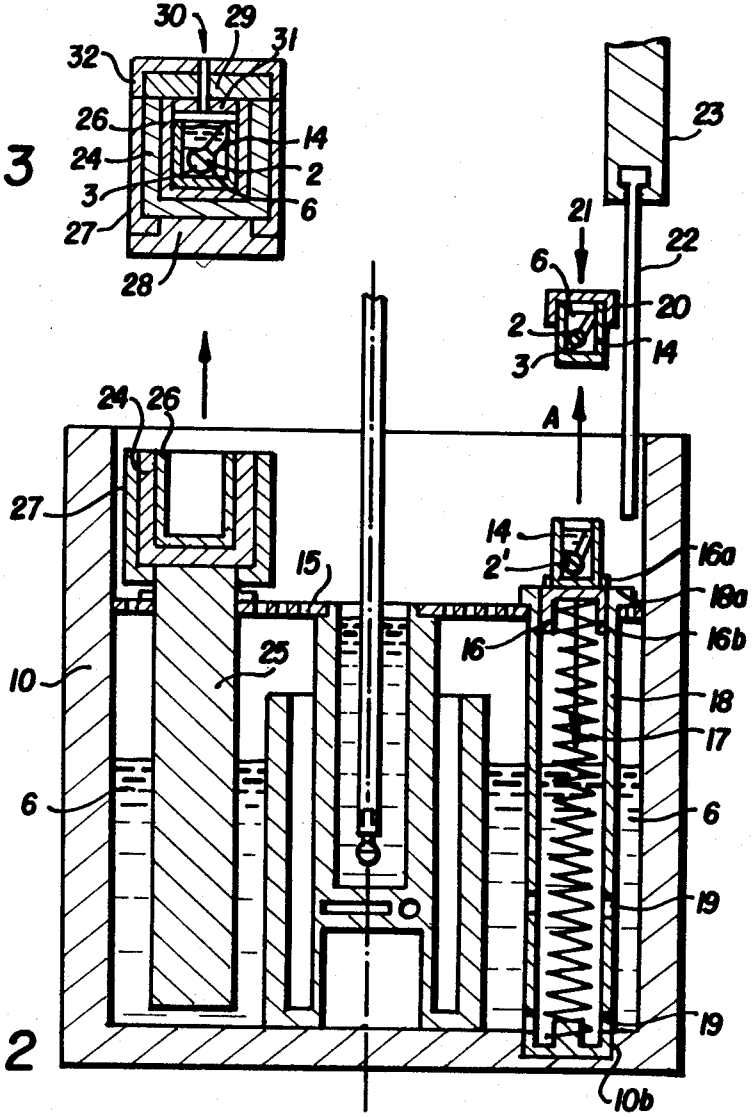
FIG. 2
FIG. 3
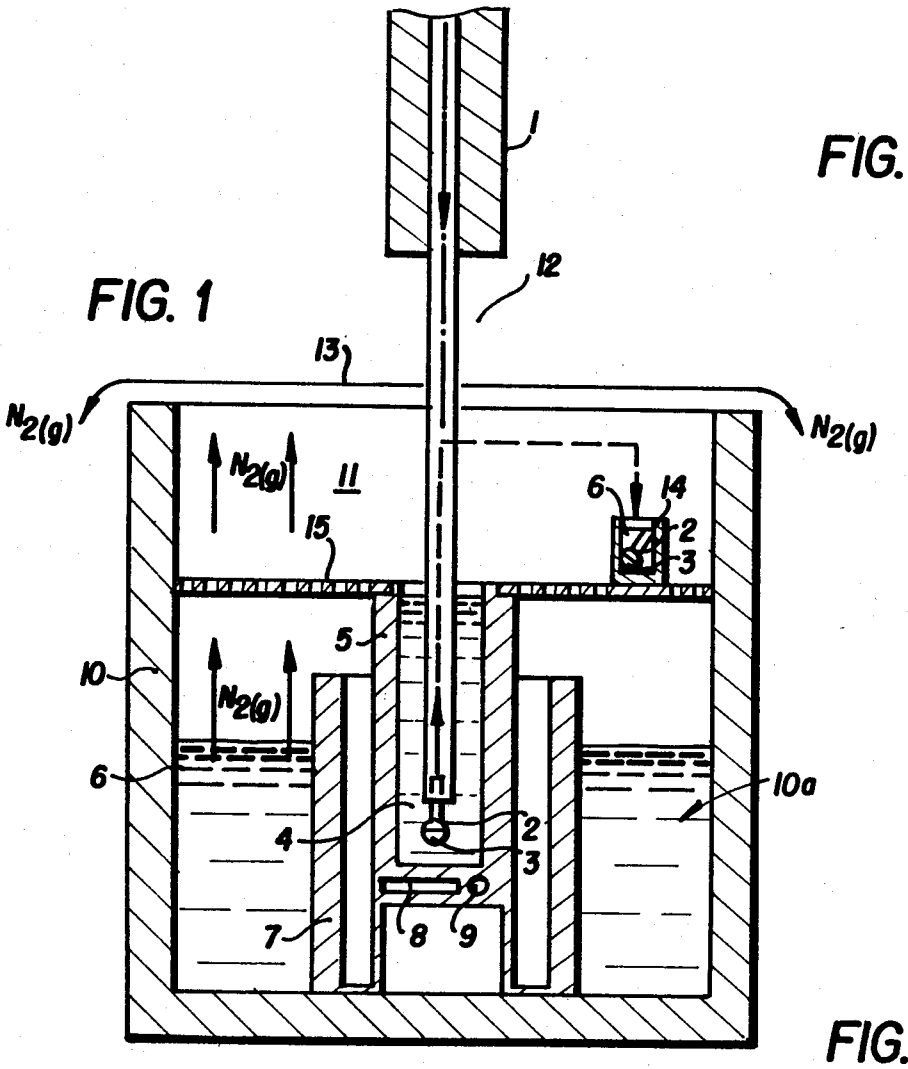
FIG. 1

DEVICE FOR THE CRYOGENIC TRANSFER OF SPECIMENS

BACKGROUND OF THE INVENTION

This invention relates to a device for the cryogenic transfer of specimens. The invention is also concerned with apparatus for the cryogenic treatment of specimens, more particularly with apparatus for the cryofixation and/or cryopreparation of specimens.

In known apparatus for cryofixation or for cryopreparation, liquid nitrogen is generally used as a coolant and is received in a cooling chamber of the apparatus for this purpose. The cryofixation of specimens in the form of biomedical test samples or similarly conditioned physico-chemical test samples is usually carried out using one of two methods. In one method the specimens are rapidly cooled by insertion into a liquid cooled close to its freezing point by the coolant; the liquid may be, for example, propane, ethane or a halogenohydrocarbon. In the other method the specimens are cooled by application to a metal surface of a metal block cooled by the coolant.

The liquid nitrogen used for cooling the liquid or the metal block is generally located beneath the liquid or beneath the metal block.

After cryofixation of the specimen it is usually placed in a specimen holder for cryotransfer to the next stage in its treatment. The apparatus for the subsequent stages such as a cryoultramicrotomy, freeze fracture, freeze drying, cryosubstitution and cryoelectron microscopy, is separate from the cryofixation apparatus. During the cryotransfer step the specimen must be maintained at a temperature in or below the range −160° C. to −100° C., because the structure of the specimen or the distribution of the individual components would change at temperatures above this range. In order to transfer without risk the specimen holder to the apparatus in the next stage of the treatment it is usual to fill the specimen holder with liquid nitrogen so that the cryotransfer of the specimen holder to the next apparatus is conducted with the specimen immersed in liquid nitrogen.

It is common for the liquid nitrogen in the cooling chamber to be covered by a cover comprising a net or sieve plate, the meshes or openings of which are dimensioned in such a way that the specimen and the specimen holder cannot pass through the cover. This prevents specimens from being accidently dropped in the liquid nitrogen from where the samples would be difficult to retrieve, and could be lost. The provision of the cover has the disadvantage that the liquid nitrogen in the cooling chamber cannot be easily transferred from the chamber to the specimen holder.

In view of this the liquid nitrogen to be put in the specimen holder prior to cryotransfer has to be obtained from another source. In practice the only other available source is from a liquid nitrogen supply container. This is not an easy operation because the amount of liquid nitrogen required for cryotransfer is about 5 ml, while the supply containers usually contain 20 to 100 litres and are not adapted to dispense small quantities of liquid nitrogen. Obtaining such small quantities of liquid nitrogen from the supply containers results in a considerable amount of wastage of the liquid nitrogen, and is not without risk to the technician performing the operation. This is an important problem because during the daily laboratory routine a large number of such cryotransfer operations have to be performed, often more than 10 per hour.

SUMMARY OF THE INVENTION

It is an object of the present invention to provide a device which enables cryogenic coolant in an apparatus to be used for the transfer of a specimen to another apparatus.

According to one aspect of the present invention there is provided a device for use in transferring a specimen from an apparatus containing a cryogenic coolant, comprising a specimen holder, and coolant transfer means for introducing coolant from said apparatus into said specimen holder, whereby a specimen in said specimen holder is immersed in said coolant.

Advantageously the coolant transfer means comprises support means for supporting the specimen holder, and guide means for guiding displacement of the support means. The guide means may extend into the coolant in the apparatus, and may also extend through a cover of the apparatus, which cover is disposed above the coolant.

Preferably the guide means comprises a tube having a plurality of openings provided therein to permit the coolant from the apparatus to enter the tube.

Desirably the support means is arranged in the tube and is spring loaded.

The tube may conveniently be provided with retaining means for retaining the support means within the tube. The retaining means may be disposed substantially at the level of the cover of the apparatus.

The support means may be arranged to be guided with lateral play in the tube. Preferably the tube has lateral guide surfaces which guide the support member, and clearance spaces are provided between the lateral guide surfaces and the support means. This facilitates the escape of air between the support means and the tube.

The support means is desirably provided with an upper surface for receiving the specimen holder, the upper surface including an annular formation within which the specimen holder can be received.

The specimen holder is preferably made of good thermally insulating material such as a foamed plastic.

A lid may be provided for the specimen holder, and an opening may be provided in the lid for the escape of coolant vapor from the specimen holder; the opening may be dimensioned so that the rate of escape of coolant vapor is great enough to prevent the entry into the specimen holder of warm and moist air from an external environment.

Displacement means may be provided for lowering the support means in the tube, and for manipulating the specimen holder; the displacement means may be provided with a thermally insulating handle.

A specimen holder container can be provided which is adapted to contain the specimen holder. The specimen holder container has a greater thermal capacity than the specimen holder, and can be pre-cooled before the specimen holder is placed in the specimen holder container. The specimen holder container may be provided with a lid, and a cryo-manipulator may be provided for manipulating the specimen holder container.

The specimen holder container may be provided with a thermally insulated inner and/or outer wall.

According to another aspect of the invention there is provided apparatus for the cryogenic treatment of specimens, comprising a vessel having a zone for receiving cryogenic coolant, a cover disposed above the zone, a specimen holder for holding a specimen, and coolant transfer means adapted to permit the specimen holder to be moved into the zone, for transferring coolant from the zone to the specimen holder.

Advantageously the coolant transfer means is the same as the coolant transfer means described above.

Furthermore, displacement means, and a specimen holder container, as described above may also be provided for use with the apparatus.

Preferably the vessel has a base, and the tube of the coolant transfer means extends to the base. A recess may be provided in the base of the vessel, and the tube may be received in the recess.

BRIEF DESCRIPTION OF THE DRAWINGS

Reference is now made to the accompanying drawings in which:

FIG. 1 is a schematic section through prior art apparatus for the cryogenic treatment of specimens;

FIG. 2 is a schematic section through apparatus for the cryogenic treatment of specimens according to the invention, having a device for use in transferring a specimen according to the invention; and FIG. 3 is a section through a specimen holder and a specimen holder container of a device according to the invention.

DESCRIPTION OF THE PREFERRED EMBODIMENTS

The construction of the cryofixing apparatus shown in FIG. 1 is of conventional type. A specimen 3 is fixed to a preparation carrier 2 provided on the end of an injector 1 and is rapidly frozen by immersing it in a cooled fluid 4. The fluid 4 is received by a metal tank 5 and is indirectly cooled by cryogenic coolant in the form of liquid nitrogen 6; a casing 7 surrounds the metal tank 5 in order to prevent direct contact between the tank 5 and the liquid nitrogen 6.

The temperature of the cooling fluid 4 is maintained at a preselected value in a known manner by means of a heating cartridge 8, a temperature sensor 9, and a control loop (not shown). Usually the preselected value is just above the melting point of the fluid 4.

The tank 5 and casing 7 are disposed in a thermally insulated or insulating vessel 10, which provides a cooling chamber having a zone 10a receiving the liquid nitrogen 6; the cooling chamber surrounds the casing 7.

Typically the liquid nitrogen 6 is refilled automatically if its level drops below a certain depth. The entire space above the liquid nitrogen 6 is filled with dry and cold gaseous nitrogen 11 which is continually being extracted by boiling off from the liquid nitrogen 6. A sharply defined boundary 13 is formed between the gaseous nitrogen 11 and warm room air 12. At the boundary 13 the temperature increases from about −160° C. to +20° C. within a distance of about 1 mm.

The frozen specimen 3 can be moved without risk below the boundary 13, for example along the dotted line out of the cooling fluid 4 into a specimen holder 14 which is located laterally next to the injector 1 on a perforated cover 15.

However, for the purposes of further preparation or examination in another apparatus, the specimen 3 cannot be conveyed in the specimen holder 14 through the room air 12 without first filling the specimen holder 14 with liquid nitrogen; otherwise the quality and value of the specimen 3 would be seriously impaired. By filling the specimen holder 14 with liquid nitrogen the specimen 3 can be transferred to another apparatus at a temperature less than about −190° C.

The cover 15 is disposed above the zone 10*a* and prevents the specimen 3 from falling into the liquid nitrogen 6, or into the space between the casing 7 and then the tank 5, when it is being manipulated within the apparatus. If the cover 15 were not provided, then the specimen 3 could accidentally be dropped into the liquid nitrogen 6 and would probably be irretrievable. It is particularly difficult to retrieve specimens from the liquid nitrogen 6 because of the large number of additional elements which are provided in the zone 10*a*. These additional elements are not shown in the drawings for the purpose of clarity, but may include, for example, a device for automatically refilling liquid nitrogen, filler level sensors, and refill lines.

The cover 15 completely closes the zone 10*a* at the level of the cooling fluid 4. Although the cover 15 allows liquid nitrogen to be poured into the zone 10*a* and allows gaseous nitrogen to be evaporated, it prevents valuable specimens from being lost in the liquid nitrogen 6. However, with the apparatus shown in FIG. 1, it is not possible to fill the specimen holder 14 with liquid nitrogen 6 from the zone 10*a*. Instead, it is necessary to fill the specimen holder 14 from an external supply vessel (not shown), which leads to the risks and inadequacies discussed above.

This problem may be solved by the provision of a device according to the invention, as shown in FIG. 2. Many of the components illustrated in FIG. 2 are similar to those shown in FIG. 1, and like parts have been designated with like reference numerals.

The device for transferring the specimen 3 from the apparatus comprises the specimen holder 14 and coolant transfer means for introducing the liquid nitrogen 6 from the zone 10*a* into the specimen holder 14. The coolant transfer means comprises support means in the form of a receptacle 16, for supporting the specimen holder 14, and guide means in the form of a tube 18. The cover 15 is provided with an opening through which the tube 18 extends downwardly. The tube provides lateral guide surfaces for guiding the receptacle 16.

A recess 106 is provided in the base of the vessel 10 and the tube 18 extends into this recess.

Openings 19 are provided in the tube 18 to permit the liquid nitrogen 6 to flow into or out of the tube 18. Some of the openings 19 are arranged adjacent the lower end of the tube 18 so that even when the depth of liquid nirogen is low the liquid nitrogen 6 can still flow into the tube 18.

The receptacle 16 is arranged to be displacable within the tube 18.

A compression spring 17 is arranged in the tube 18 and acts upon the receptacle 16 in an upward direction in order to bias the receptacle towards the position shown in FIG. 2.

The receptacle 16 is of annular cross-section and is dimensioned in such a way that it is guided with clearance at the inner wall of the tube 18. A shoulder 18*a* is provided at the top of the tube 18 and is adapted to engage a corresponding shoulder 16*b* provided on the receptacle 16. The should 18*a* forms a stop for the receptacle 16.

When there is no vertical force acting downwardly on the specimen holder 14 or the receptacle 16 to overcome the pretensioning force of the spring 17, the receptacle 16 is located at about the level of the cover 15, and the specimen holder 14 on top of the receptacle 16 is located in a position which enables the frozen specimen 3 to be inserted on a preparation carrier 2'. This operation can be conducted within the apparatus so that the specimen 3 is protected and kept cool by the gaseous nitrogen 11.

In order to retain reliably the specimen holder 14 on the receptacle 16 an annular formation **16*a* is provided on the upper surface of the receptacle 16. The inner diameter of the formaton 16*a* is slightly larger than the outer diameter of the specimen holder 14, so that the specimen holder can sit upon the upper surface of the receptacle 16 within the formation 16*a***.

The force of the spring 17 can be overcome by exerting a downward force on the specimen holder 14. This moves the specimen holder 14 to the liquid nitrogen 6 located in the tube 18, so that the specimen holder 14 can be filled with the liquid nitrogen 6. When the downward force is withdrawn, the spring 17 urges the receptacle 16 and the specimen holder 14 upwardly, to the position determined by the shoulder **18*a***.

A clearance can be provided between the outer surface of the receptacle 16 and the inner surface of the tube 18 in order to prevent the liquid nitrogen 6 from being forced out of the tube 18 to an excessive extent when the receptacle is moved downwardly; this enables air to escape upwardly through the tube past the side of the receptacle 16. In FIG. 2, the clearance is shown as passages in the form of, for example, longitudinal grooves which are provided in the side wall of the receptacle 16.

Displacement means in the form of a metal manipulator 22 is provided for lowering the specimen holder 14 below the level of the liquid nitrogen 6 in the tube 18, and for the transfer of the specimen holder 14 to other apparatus. The manipulator 22 has a thermally insulating handle 23.

When the specimen holder 14 is filled with the liquid nitrogen 6 it can be closed by a lid 20 which has been precooled in the apparatus by the gaseous nitrogen 11. The lid 20 has a small opening 21 to enable the gaseous nitrogen formed from the liquid nitrogen in the specimen holder 14 to escape. The specimen holder 14 is advantageously made of an insulating material, for example a foamed plastic such as polyurethane. In FIG. 2 an arrow A shows how the specimen holder 14 closed by the lid 20 is removed from the apparatus.

It is sometimes necessary to move the specimen holder 14 for some distance between two apparatusses, for example from one building to another building. To provide for this eventuality the specimen holder 14 can be accommodated in a larger specimen holder container 24. The specimen holder container 24 has considerably greater mass and thermal capacity than the specimen holder 14, and thus heats up much more slowly.

The specimen holder container 24 can be cooled down to the temperature of the liquid nitrogen by a cooling finger 25 which is made of a good thermally conducting metal. The cooling finger 25 extends through an opening in the cover 15 and projects downwardly into the liquid nitrogen 6. The specimen holder container 24, which is conveniently also made of metal, fits on the metallic upper face of the cooling finger 25 during the cooling down period, and is cooled close to the temperature of the liquid nitrogen 6. The specimen holder container 24 is provided with additional thermally insulating layers 26, 27 and 28, and can be closed by a metal lid 29 having a small opening 30 for allowing gaseous nitrogen to escape. The lid 29 is insulated by insulating layers 31 and 32. The lid 29 can also be cooled in a similar way to the specimen holder container 24 in the cooling chamber.

It will be appreciated that the device according to the invention can be used with a variety of cryogenic treatment apparatusses. For example, the tank 5 and fluid 4 could be replaced by a metal block having a mirror surface for metal mirror surface cryofixation. Moreover the apparatus could comprise, for example, apparatus for machining frozen test samples by milling tools or for cementing test samples to special holders.

The materials of construction of the specimen holder 14, the specimen holder container 24, the lid 20, the lid 29 and the cooling finger 25 may be varied according to specific requirements. In addition, the tube 18 can be designed differently to the preferred embodiment described. For example, it could be open at its lower end, and a different form of support for the spring 17 could be provided.

I claim:

1. A device for use in transferring a specimen from an apparatus containing a cyrogenic coolant comprising a specimen holder and coolant transfer means for introducing coolant from said apparatus into said specimen holder whereby a specimen in said specimen holder is immersed in said coolant, said coolant transfer means including support means for supporting the specimen holder and guide means for guiding displacement of the support means, the guide means comprising a tube having a plurality of openings provided therein to permit said coolant to enter the tube.

2. A device according to claim 1 wherein the support means is arranged in the tube and is spring-loaded.

3. A device according to claim 1 in which the tube is provided with a retaining means for retaining the support means within the tube.

4. A device according to claim 1 wherein the support means is guided with lateral play in the tube.

5. A device according to claim 1 wherein the tube is provided with lateral guide surfaces which guide the support member, and wherein clearance spaces are provided between the lateral guide surfaces and the support means.

6. A device according to claim 1 wherein displacement means is provided for lowering the support means in the tube and for manipulating the specimen holder, said displacement means having a thermally insulated handle.

7. A device for use in transferring a specimen from an apparatus containing a cryogenic coolant comprising a specimen holder, coolant transfer means for introducing coolant from said apparatus into said specimen holder whereby a specimen in said specimen holder is immersed is said coolant, and a specimen holder container which can be precooled and which has a greater thermal capacity than the specimen holder, said specimen holder container being adapted to contain the specimen holder and being provided with a lid and wherein a cooling finger made of good thermally conducting material can be arranged to extend into the coolant in the apparatus, the cooling finger having an upper surface with which the specimen holder container can be placed in contact in order to precool the specimen holder container.

8. Apparatus for the cryogenic treatment of specimens comprising:

a vessel having a zone for receiving cryogenic coolant, a cover disposed above the zone, a specimen holder for holding a specimen, and coolant transfer means adapted to permit the specimen holder to be moved into the zone, for transferring coolant from the zone to the specimen holder.

9. Apparatus according to claim 8 wherein the coolant transfer means comprises support means for the specimen holder, said support means being displaceable relative to the zone, and guide means for guiding the displacement of the support means.

10. Apparatus according to claim 9 wherein the guide means comprises a tube extending through the cover into the zone, and wherein openings are provided in the tube to permit coolant to enter the tube.

11. Apparatus according to claim 10 wherein the support means is arranged in the tube and is spring loaded.

12. Apparatus according to claim 10 wherein a recess is provided in a base of the vessel, and the tube is received in said recess.

13. A device for use in transferring a specimen from an apparatus containing a cyrogenic coolant comprising a specimen holder in the form of a receptacle for cyrogenic coolant and coolant transfer means for moving said specimen holder between a lowered position within said cyrogenic coolant at which said holder retainably accepts coolant flowing therein and an elevated position at which said specimen holder is substantially removed from said coolant.

14. A device according to claim 13 wherein said coolant transfer means includes support means for supporting the specimen holder and guide means for guiding displacment of the support means between said lowered and elevated positions of said specimen holder.

15. A device according to claim 14 wherein the support means has an upper face for receiving the specimen holder, said upper face including an annular formation within which the specimen holder can be received.

16. A device according to claim 13 wherein the specimen holder is made of a good thermally insulating material.

17. A device according to claim 13 wherein a lid is provided for the specimen holder, an opening is provided in said lid for the escape of coolant vapor, said opening being dimensioned so that the rate of escape of coolant vapor is great enough to prevent the entry into the specimen holder of warm and moist air from an external environment.

18. A device according to claim 13 further comprising a specimen holder container which can be precooled and which has a greater thermal capacity than the specimen holder, said specimen holder container being adapted to contain the specimen holder, and being provided with a lid.

19. A device according to claim 18 wherein the specimen holder container is provided with a thermally insulated inner wall.

20. A device according to claim 18 wherein the specimen holder container is provided with a thermally insulated outer wall.

* * * * *